US012320609B2

(12) United States Patent
Yollu et al.

(10) Patent No.: US 12,320,609 B2
(45) Date of Patent: Jun. 3, 2025

(54) QUICK DISASSEMBLY RECOIL GROUP STRUCTURE FOR FIREARMS

(71) Applicant: ATA SILAH SANAYI ANONIM SIRKETI, Istanbul (TR)

(72) Inventors: Fatih Yollu, Istanbul (TR); Halil Ibrahim Sen, Istanbul (TR)

( * ) Notice: Subject to any disclaimer, the term of this patent is extended or adjusted under 35 U.S.C. 154(b) by 0 days.

(21) Appl. No.: 18/579,447

(22) PCT Filed: May 22, 2023

(86) PCT No.: PCT/TR2023/050459
§ 371 (c)(1),
(2) Date: Jan. 15, 2024

(87) PCT Pub. No.: WO2024/237874
PCT Pub. Date: Nov. 21, 2024

(65) Prior Publication Data

US 2025/0085069 A1 Mar. 13, 2025

(30) Foreign Application Priority Data

May 16, 2023 (TR) ..... 2023/005453

(51) Int. Cl.
*F41A 3/82* (2006.01)

(52) U.S. Cl.
CPC ..... *F41A 3/82* (2013.01)

(58) Field of Classification Search
CPC .... F41A 3/82; F41A 3/80; F41A 25/10; F41A 25/12
See application file for complete search history.

(56) References Cited

U.S. PATENT DOCUMENTS

| | | | | |
|---|---|---|---|---|
| 6,418,833 | B1 | 7/2002 | Hajjar | |
| 8,677,664 | B2 | 3/2014 | Caravaggi et al. | |
| 9,995,553 | B1 * | 6/2018 | Oglesby | F41A 3/80 |
| 2010/0050492 | A1 | 3/2010 | Faifer | |
| 2014/0102287 | A1 | 4/2014 | Jebsen et al. | |
| 2022/0299281 | A1 | 9/2022 | Li et al. | |

FOREIGN PATENT DOCUMENTS

CN 113945116 A 1/2022

OTHER PUBLICATIONS

International Search Report for corresponding PCT/TR2023/050459 dated Dec. 21, 2023.
Written Opinion of the International Searching Authority for corresponding PCT/TR2023/050459 dated Dec. 21, 2023.

* cited by examiner

*Primary Examiner* — J. Woodrow Eldred
(74) *Attorney, Agent, or Firm* — Egbert, McDaniel & Swartz, PLLC

(57) ABSTRACT

Disclosed is a quick disassembly recoil group structure for firearms that are used in hunting and defense fields and that have various recoil groups due to its working principle, which enables simple assembly and disassembly of the recoil group using various hand tools in cases where cleaning, maintenance or part replacement is required.

3 Claims, 4 Drawing Sheets

QUICK DISASSEMBLY RECOIL GROUP STRUCTURE FOR FIREARMS

TECHNICAL FIELD

The invention relates to quick disassembly recoil group structure for firearms.

The invention particularly relates to quick disassembly recoil group structure for firearms that are used in hunting and defense fields and that have various recoil groups due to its working principle, which enables simple assembly and disassembly of the recoil group using various hand tools in cases where cleaning, maintenance or part replacement is required.

BACKGROUND OF THE INVENTION

Firearms such as pistols and rifles are known as structures that are frequently used in the hunting and defense industry.

It is very important that the aforementioned weapons are quickly disassembled in the field and quickly reassembled when needed.

It is only possible for the users to perform the disassembly and reassembly operations mentioned, with auxiliary tools or apparatus. To achieve this goal, users have to carry tools and apparatus with them.

Recoil groups in firearms, according to the working principle of the gun, behind the body, inside the stock, under the barrel, on the barrel, etc. can be in various locations. Most semi-automatic and automatic rifles have a tubular recoil tube and recoil spring.

Since the recoil group is the most important group that ensures the operation of the weapon, it must be cleaned, maintained and lubricated periodically.

Weapons used in hunting, especially in water hunts, absorb moisture and water very quickly, and they need to be disassembled and maintained more frequently in periodic maintenance.

These recoil groups are designed as closed systems, and in dismantling operations, sockets, keys, etc. are not used. hand tools are used. This not only brings the need for additional equipment, but also brings problems such as wear, damage, over- or under-tightening of key blades over time, since recoil groups are small and unstable systems.

In the literature, in the US patent application numbered U.S. Pat. No. 8,677,664B2, "A bolt for locking the stock to a receiver of a firearm having mobile masses, comprising a tubular element which can be closed at the ends respectively by means of a bolt-body cap which can be screwed to the receiver and by means of a bolt-stock cap on which the stock can be tightened, the tubular element housing in its interior a mechanism for damping the withdrawal speed of the mobile masses of the firearm, situated on their withdrawal trajectory and equipped with a free end not connected to the mobile masses and destined for coming into contact with the latter during their withdrawal movement following the firing of the firearm for damping the stress." statements are included.

The butt bolt of a firearm equipped with a damping mechanism is disclosed in the mentioned application.

Also in the literature, in the US patent application numbered U.S. Pat. No. 6,418,833B1 regarding the subject, "An improved recoil spring tube assembly for an auto-loading firearm includes a recoil spring slideable within a recoil spring tube and including a recoil spring follower all manufactured of a corrosion resistant material. The bore of the recoil spring tube and the contact surface area of the guide collar of the recoil spring follower are honed or polished to provide a surface having an average surface roughness between 1.0 muin. and 30.0 muin. The recoil spring tube assembly is configured such that the recoil spring has a spring rate greater than 0.80. In one embodiment of the invention, the recoil spring tube assembly includes a recoil spring follower sized and configured so as to have a mass that results in an assembly wherein the ratio of the recoil spring follower mass to the recoil spring rate, or displacement constant is in the range of 0.10-0.30." statements are included.

In the mentioned application, the recoil spring tubing for firearms is disclosed.

Also in the literature, in the US patent application numbered US2014102287, regarding the subject, "The invention comprises an improved recoil control device comprising a bolt head and an inertia block or slider for use in a variety of firearms. In one embodiment, the bolt head and inertia block are articulated so that the displacement of the bolt head results in a force component outside the firing axis of the barrel of the firearm. The device can be incorporated into firearms of a variety of sizes and configurations to produce recoil reduction and/or weight reduction advantages." statements are included.

In the aforementioned patent, a firearm with improved recoil and control features is disclosed.

Due to the disadvantages mentioned above, it was necessary to introduce a quick disassembly recoil group structure for firearms.

DISCLOSURE OF THE INVENTION

Based on this position of the technique, the aim of the invention is to present a new quick disassembly recoil group structure for firearms that eliminates the existing disadvantages.

Another aim of the invention is to present a structure that allows assembly and disassembly to be done by hand in a simple and fast manner without using hand tools.

Another aim of the invention is to present a structure that eliminates the necessity of carrying the tools and apparatus that the users have to use to carry out the disassembly process.

Another aim of the invention is to present a structure that enables users to have much higher mobility, as they do not have to carry tools and apparatus with them, thus contributing to the success of operations.

REFERENCE NUMBERS

A—Recoil Group Structure
1. Recoil Tube
2. Recoil Nut
3. Locking Piece
4. Locking Spring
5. Centering Bushing
6. Segment

DETAILED DESCRIPTION OF THE INVENTION

In this detailed explanation, the innovation that is the subject of the invention is only explained with examples that will not have any limiting effect for a better understanding of the subject.

The invention a quick disassembly recoil group structure (A) for firearms that are used in hunting and defense fields and that have various recoil groups due to its working principle, which enables simple assembly and disassembly of the recoil group using various hand tools in cases where cleaning, maintenance or part replacement is required and comprising at least one recoil tube (1) positioned on the firearms characterized in that; comprise the recoil nut (2) screwed into the said recoil tube (1) in order to ensure that the assembly/disassembly process can only be done by hand, locking piece (3) positioned on the recoil nut (2), which locks said recoil nut (2) on the recoil tube (1), the locking spring (4) which is placed inside the said locking piece (3) and compresses it on the recoil nut (2) of the locking piece (3).

Figure 1:
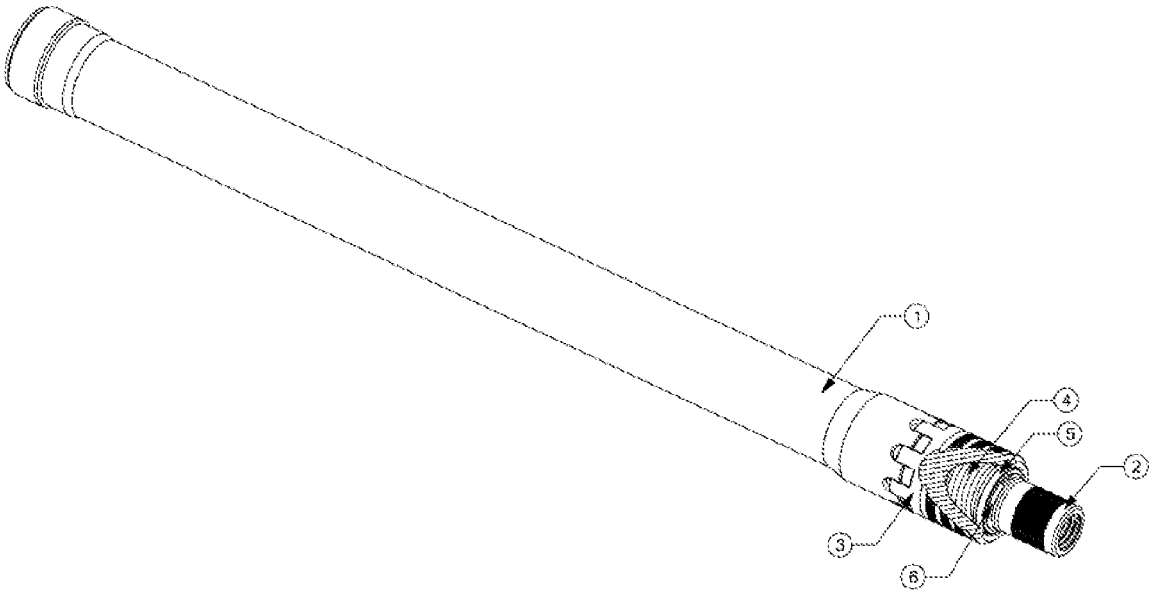
FIG. 1 Sectional view of the recoil group structure, which is the subject of the invention.

FIG. 1 shows a sectional view of the recoil group structure, which is the subject of the invention.

Figure 2:
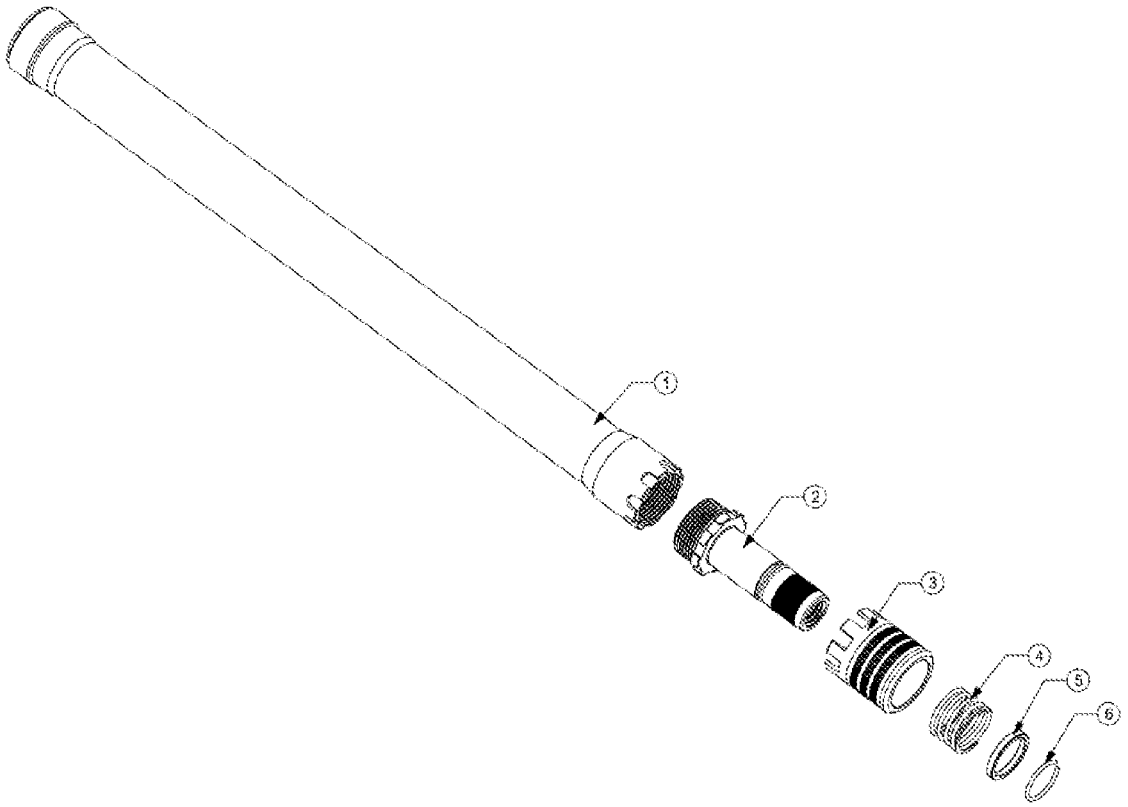
FIG. 2 Assembly view of the recoil group structure, which is the subject of the invention.

FIG. 2 shows an assembly view of the recoil group structure, which is the subject of the invention.

Figure 3:
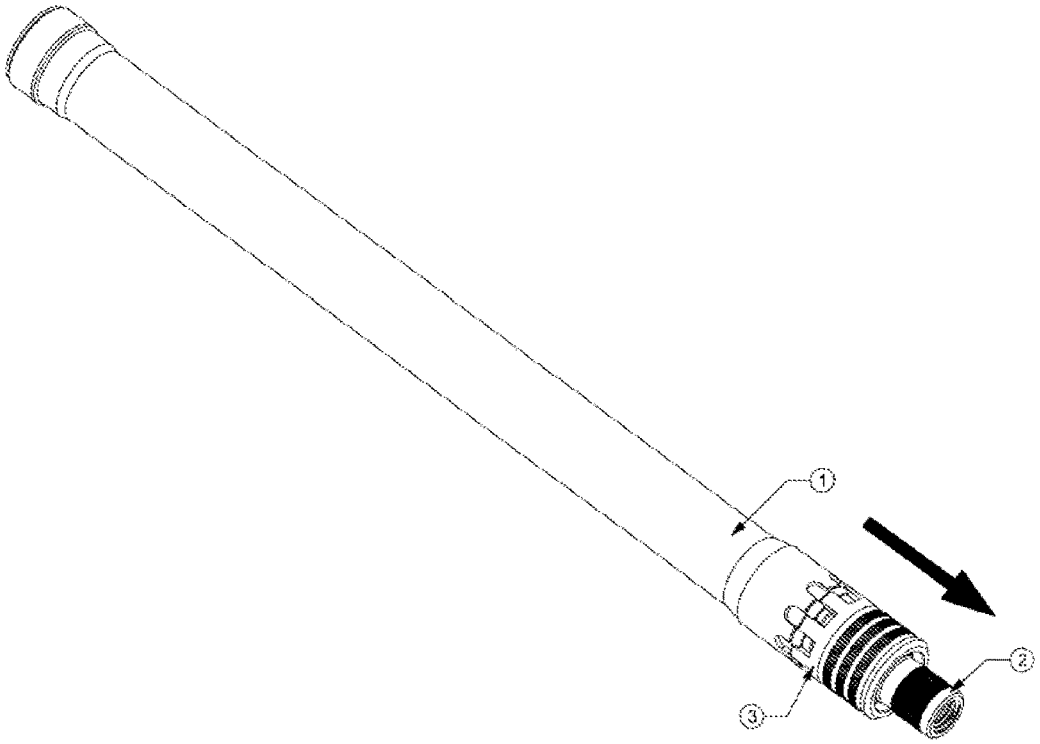
FIG. 3 The view of the recoil group structure, which is the subject of the invention, with the description of disassembly.

FIG. 3 shows the view of the recoil group structure, which is the subject of the invention, with the description of disassembly.

Figure 4:
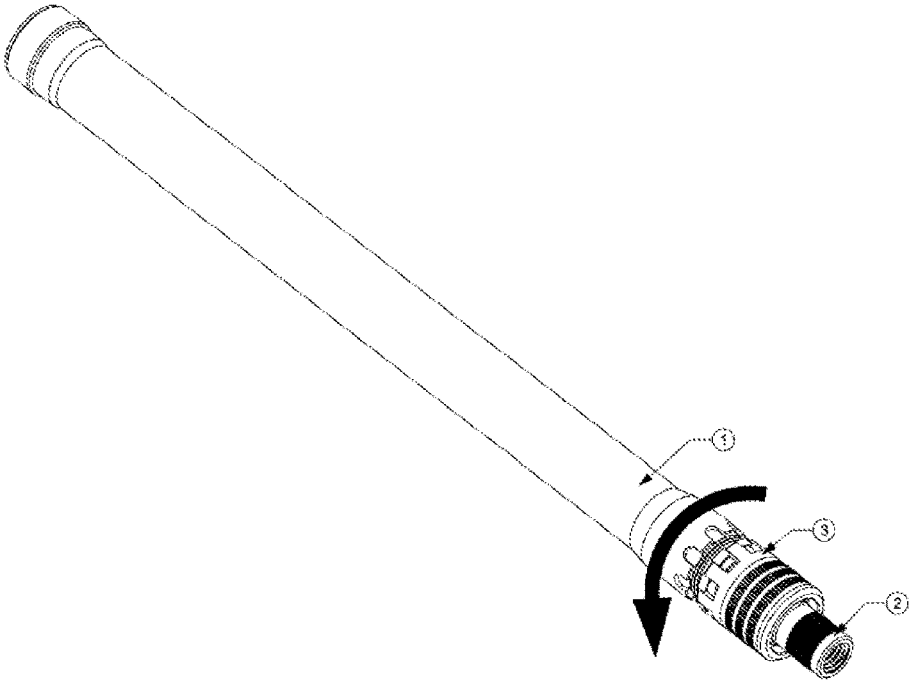
FIG. 4 Another view of the recoil group structure, which is the subject of the invention, with a disassembly description.

FIG. 4 shows another view of the recoil group structure, which is the subject of the invention, with a disassembly description.

Figure 5:
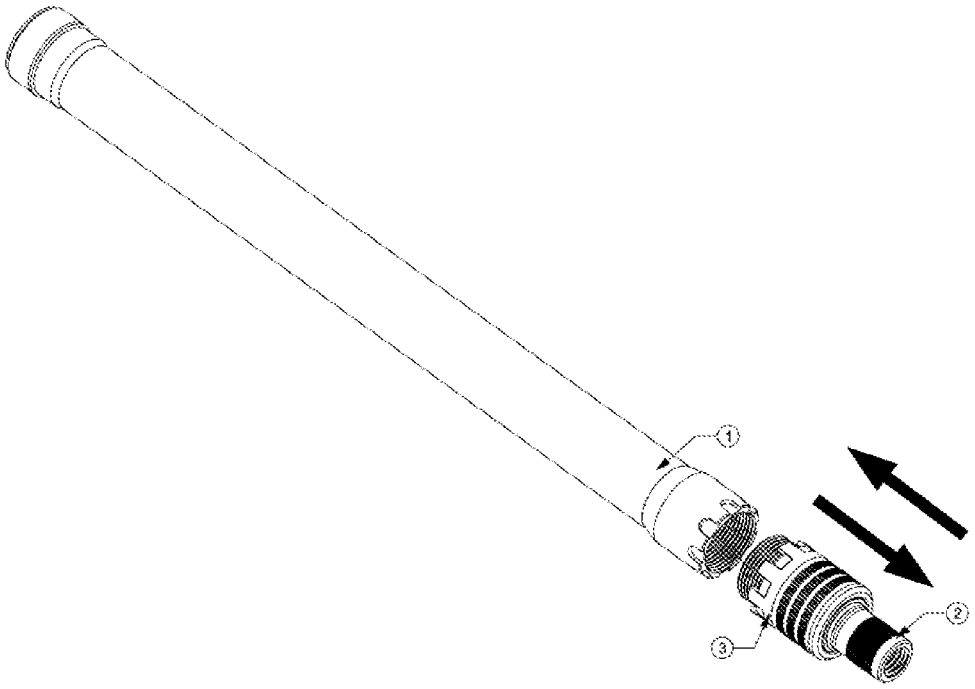
FIG. 5 The disassembled view of the recoil group structure, which is the subject of the invention.

FIG. 5 shows the disassembled view of the recoil group structure, which is the subject of the invention.

Figure 6:
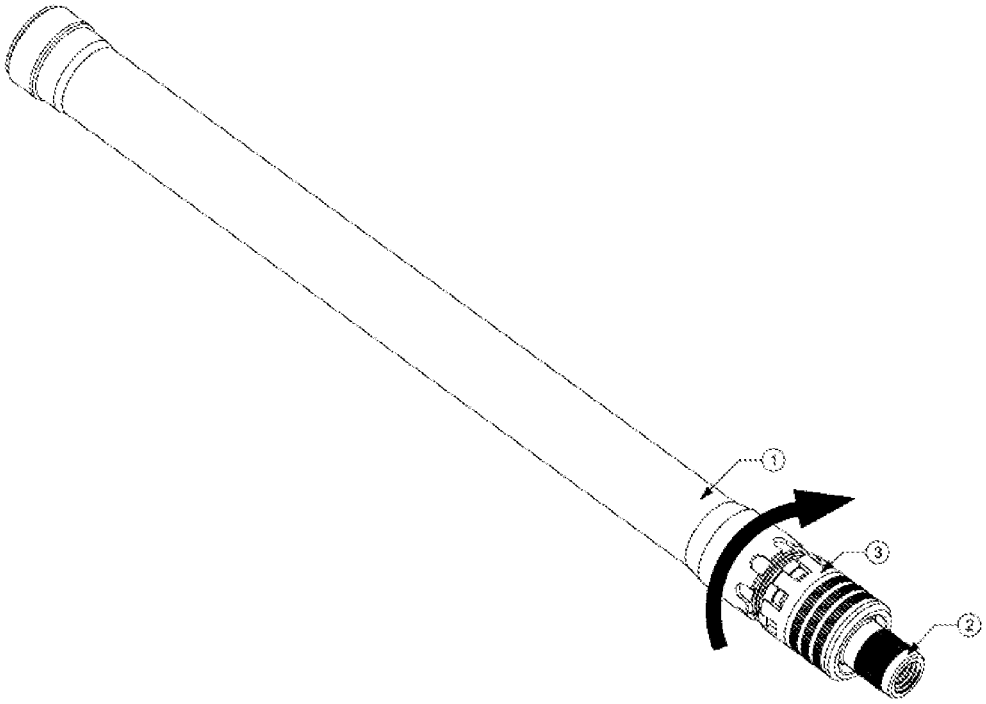
FIG. 6 View of the recoil group structure, which is the subject of the invention, with an assembly description.

FIG. 6 shows the view of the recoil group structure, which is the subject of the invention, with an assembly description.

Figure 7:
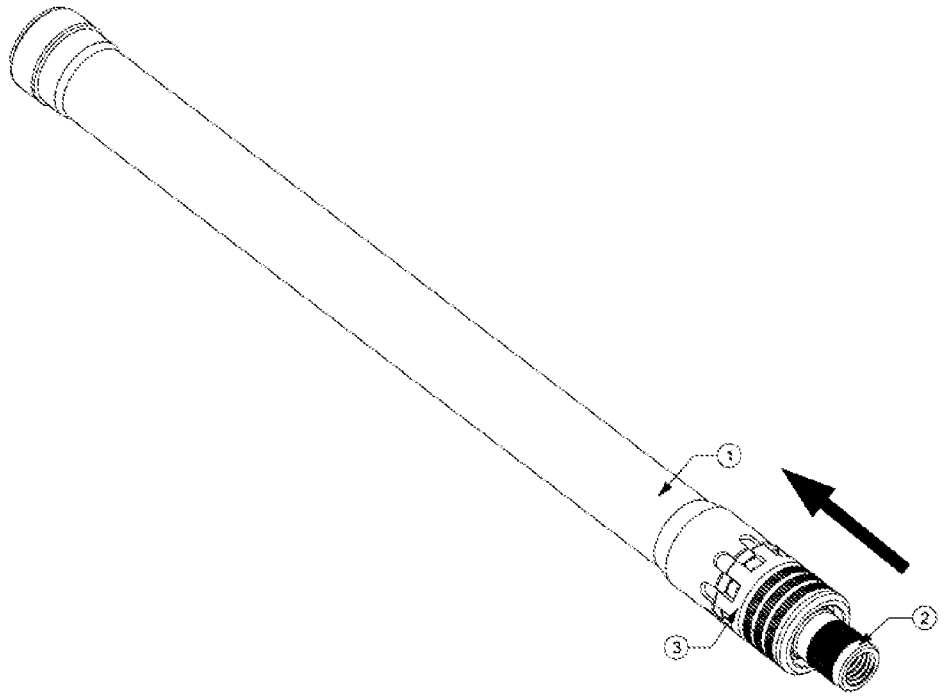
FIG. 7 Another view of the recoil group structure, which is the subject of the invention, with an assembly description.

FIG. 7 shows another view of the recoil group structure, which is the subject of the invention, with an assembly description.

Figure 8:
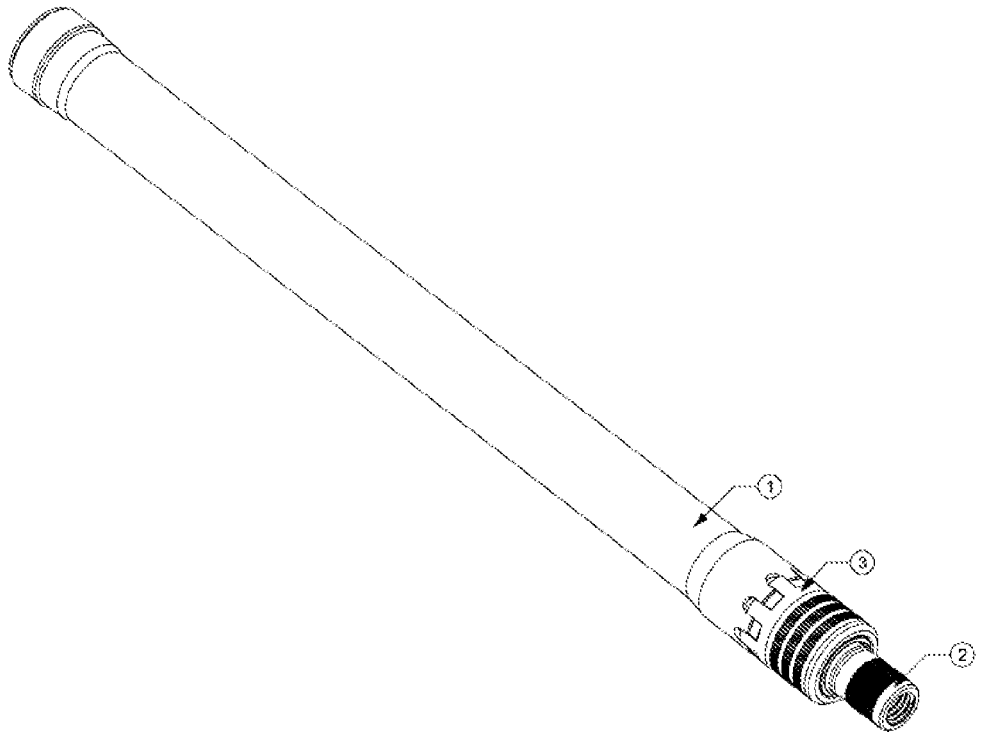
FIG. 8 Assembled view of the recoil group structure, which is the subject of the invention.

FIG. 8 shows assembled view of the recoil group structure, which is the subject of the invention.

Recoil group structure (A) for firearms according to invention consist main parts of at least one recoil tube (1) positioned on the weapon, the recoil nut (2) screwed to the said recoil tube (1), the locking piece (3) positioned on the said recoil nut (2), the locking spring (4) which is placed in the said locking piece (3), centering bushing (5) limiting said locking spring (4) and segment (6) fixing said centering bushing (5).

In order to quick disassembly recoil group structure (A) for firearms, which is the subject of the invention, the locking piece (3) is turned back over the recoil tube (1), and the recoil nut (2) is separated from the recoil tube (1) by manually moving to the right/left.

Similarly, in order to carry out an assembly operation, the recoil nut (2) is connected to the recoil tube (1) with a right/left hand movement and locked with the forward movement of the locking piece (3).

Said locking spring (4) is positioned inside the locking piece (3) and compresses the locking spring (4) on the recoil nut (2).

The centering bushing (5) is positioned to limit the movement of said locking spring (4) in the opposite direction to compression.

The aforementioned centering bushing (5) is also fixed by means of the segment (6).

The invention claimed is:

1. A recoil assembly for a firearm that allows quick assembly and disassembly, the recoil assembly comprising:
- at least one recoil tube adapted to be positioned on the firearm;
- a recoil nut screwed into said at least one recoil tube;
- a locking piece positioned on said recoil nut, said locking piece locking said recoil nut onto said at least one recoil tube; and
- a locking spring positioned inside said locking piece, said locking spring compressed against said recoil nut so as to urge against said recoil nut of said locking piece such that the quick assembly and disassembly is carried out without tools.

2. The recoil assembly of claim 1, further comprising:
a center bushing bearing against said locking spring.

3. The recoil assembly of claim 2, further comprising:
a segment fixed onto said centering bushing.

* * * * *